US007473051B2

(12) United States Patent
Audet

(10) Patent No.: US 7,473,051 B2
(45) Date of Patent: Jan. 6, 2009

(54) FLEXIBLE ROUTE MARKER

(76) Inventor: Sylvain Audet, 1642, rue Gauthier, St-Théodore d'Acton, Québec (CA) J0H 1Z0

( * ) Notice: Subject to any disclaimer, the term of this patent is extended or adjusted under 35 U.S.C. 154(b) by 0 days.

(21) Appl. No.: 11/606,514

(22) Filed: Nov. 30, 2006

(65) Prior Publication Data

US 2008/0131201 A1 Jun. 5, 2008

(51) Int. Cl.
*E01F 9/017* (2006.01)

(52) U.S. Cl. ..... 404/10; 40/608; 40/612; 116/63 R

(58) Field of Classification Search ..... 404/9, 404/10; 40/608, 612; 116/63 R
See application file for complete search history.

(56) References Cited

U.S. PATENT DOCUMENTS 4,084,914 A * 4/1978 Humphrey et al. ..... 404/10
4,245,922 A * 1/1981 Auriemma ..... 404/10
5,205,236 A * 4/1993 Hughes ..... 116/63 R
5,483,917 A * 1/1996 Walker ..... 116/63 P
5,788,405 A * 8/1998 Beard ..... 404/10
6,053,658 A * 4/2000 Gibson, Jr. ..... 404/10
6,375,385 B1 * 4/2002 Kennedy ..... 404/10

* cited by examiner

*Primary Examiner*—Gary S Hartmann
(74) *Attorney, Agent, or Firm*—Eric Fincham

(57) ABSTRACT

A flexible route marker post which comprises an upright post having an upper end and a lower end, the lower end having first and second flexible members secured thereto, the lower end of the flexible members being secured to a base, the arrangement being such that there is a bending zone in between the upright post and the base. The upper end and the lower end of the post have a reinforcing material extending thereabout.

9 Claims, 2 Drawing Sheets

FLEXIBLE ROUTE MARKER

FIELD OF THE INVENTION

The present invention relates to a route marker and more particularly, relates to a route marker which is flexible and which can be used on different types of surfaces.

BACKGROUND OF THE INVENTION

The use of posts to carry signs or to otherwise demarcate a certain zone is well known. Thus, one will encounter posts at most public parking lots, the posts typically carrying signs to convey information to a motorist such as "Reserved parking", "No parking", etc.

Posts have also been used to indicate a route either for vehicles or pedestrians. The use of posts to separate bicycle or walking paths from other vehicular traffic is well known in the art. However, the use of a rigid post is not desirable in that the posts inevitably are impacted by vehicles. The posts must then be replaced. Also, there is the risk of substantial damage to the vehicle.

The use of flexible posts is also well known in the art. However, generally such flexible posts have not been designed to withstand impact from a vehicle while at the same time, providing a highly visible marking.

SUMMARY OF THE INVENTION

It is an object of the present invention to provide a flexible post and more particularly, a flexible route marker able to withstand impact from a vehicle.

It is a further object of the present invention to provide a flexible route marker which is highly visible and which will return to its original position following impact.

According to one aspect of the present invention, there is provided a flexible marker post comprising a base, first and second flexible members secured to the base and extending upwardly therefrom, a post mounted intermediate of the first and second flexible members, the post having a lower end thereof secured to the first and second flexible members, the post having a reflective material thereon, and an upper reinforcing material surrounding an upper end of the post, and a lower reinforcing portion surrounding the lower end of the post.

The flexible route marker of the present invention, as above stated, includes first and second flexible members secured to a base and extending upwardly thereto. The flexible members sandwich a post which is mounted intermediate of the first and second flexible members. The flexible members are preferably formed of an elastomeric material and most preferably are formed of a rubber material. The flexible members are sized to provide the desired resiliency and to this end, the material itself may be varied depending upon the requirements of the particular application. Thus, the flexible members can be made more or less flexible depending upon the impact which is anticipated to be received and the frequency of the impacts.

The post mounted intermediate of the flexible members preferably has a first side which is concave and a second side which is convex in configuration. An impact resistant plastic material is one of the preferred materials and will have a greater stiffness than the flexible support to thereby allow the flexible support to bend upon an impact force being applied thereto. After the impact force is removed, the post will resume its normal upright position.

The post preferably incorporates reflective material, the reflective material being incorporated on the convex and concave side of the post. Such reflective material is well known in the art and any suitable material may be utilized though a reflective material providing a yellow reflection is preferred. In such an instance, the post is normally black with the yellow reflective material being secured thereto.

The base is formed of a metallic material such as steel. The base is arranged to be secured to a substrate and to sandwich the flexible members.

BRIEF DESCRIPTION OF THE DRAWINGS

Having thus generally described the invention, reference will be made to the accompanying drawings illustrating an embodiment thereof, in which.

DETAILED DESCRIPTION OF THE INVENTION

Figure 1:
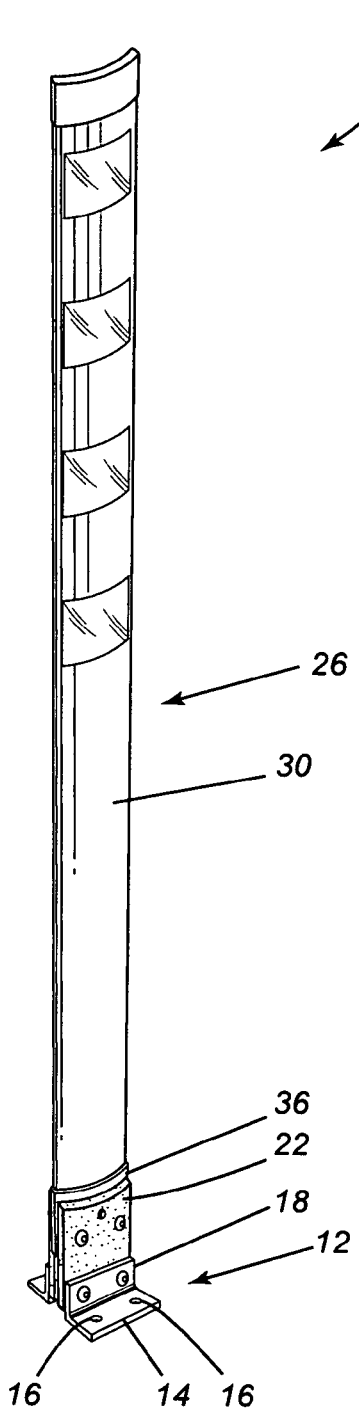
FIG. 1 is a perspective view of a flexible marker post according to the present invention.
Figure 2:
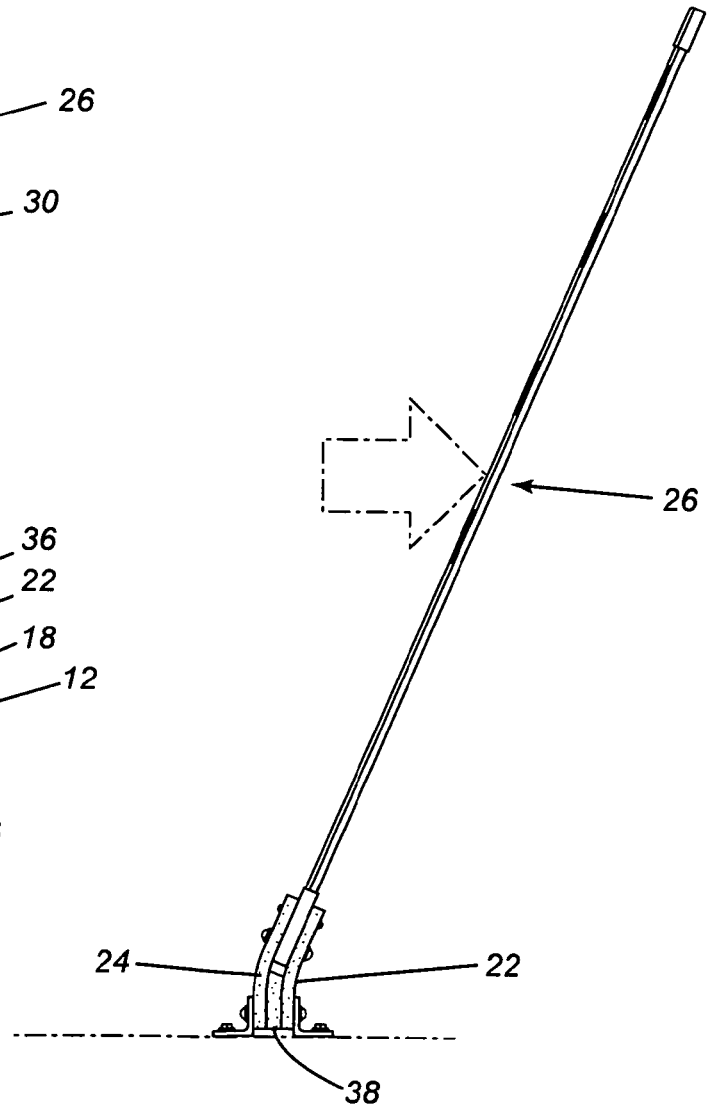
FIG. 2 is a side elevational view showing the flexible marker post yielding upon an impact force being applied thereto.
Figure 3:
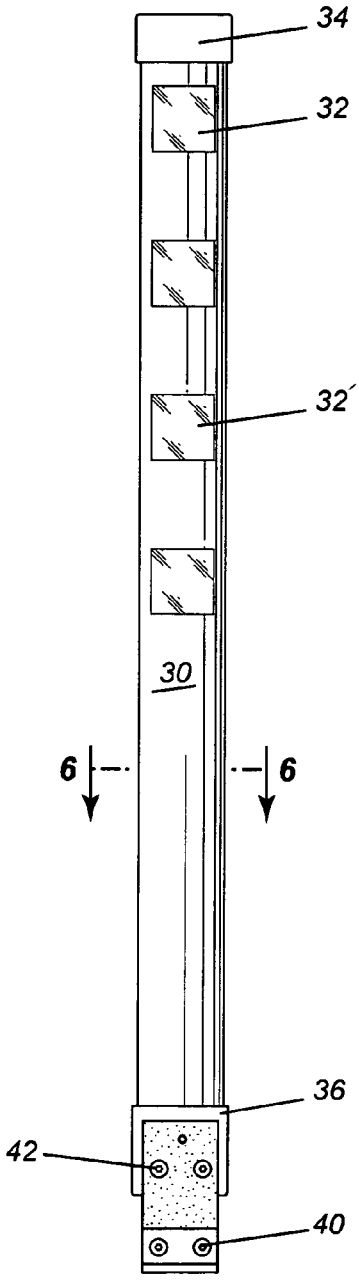
FIG. 3 is a front elevational view of the flexible marker post.
Figure 4:
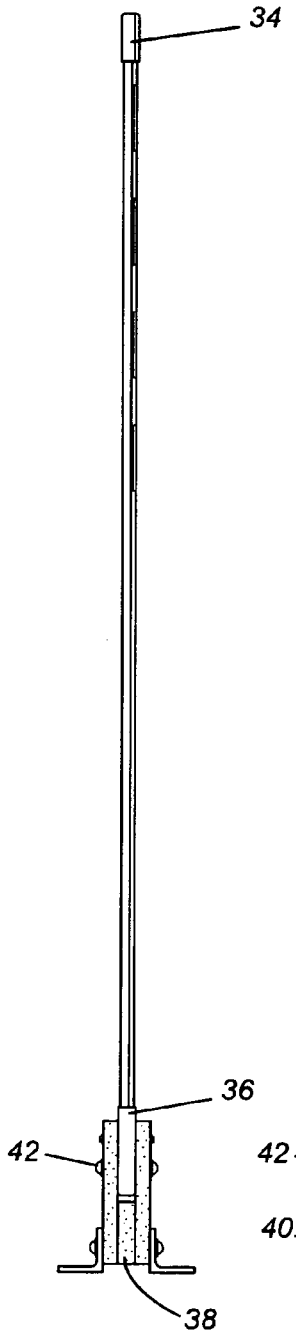
FIG. 4 is a side elevational view thereof.
Figure 5:
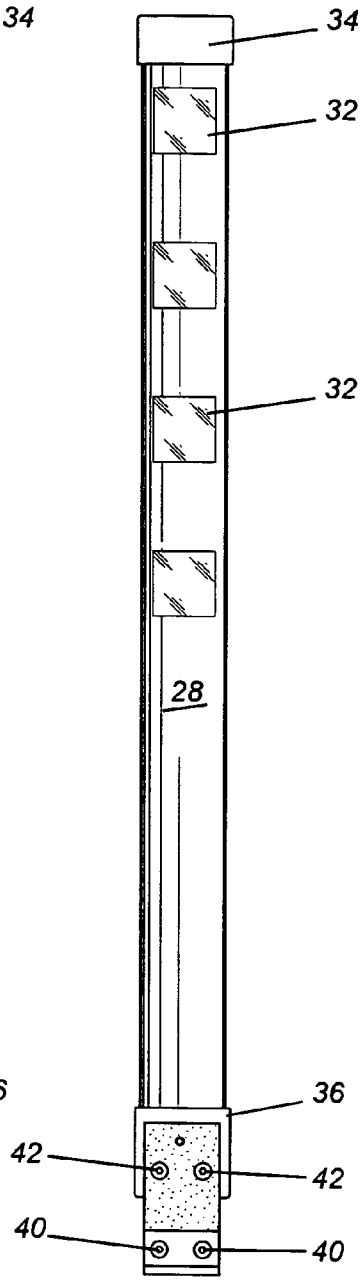
FIG. 5 is a rear elevational view thereof.
Figure 6:
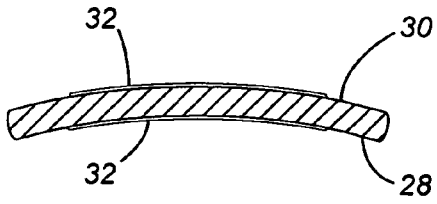
FIG. 6 is a cross-sectional view taken along the lines 6-6 of FIG. 3.

Referring to the drawings in greater detail and by reference characters thereto, there is illustrated in FIG. 1 a flexible route marker which is generally designated by reference numeral 10.

Route marker 10 has securement means 12 for securing the route marker to a substrate. The substrate may be any conventional and would generally include the ground, asphalt, concrete, etc. Each securement means comprises a base 14 having apertures 16 therein and an upright portion 18. Between the two upright portions 18, there are provided a pair of flexible members 22 and 24. As previously stated, flexible members 22 and 24 are formed of a known suitable material such as rubber or other desired elastomeric material.

A post 26 is secured between flexible members 22 and 24 and in the preferred illustrated embodiment, has a concave side 28 and a convex side 30. A plurality of reflective material portions 32 are applied to the convex side 30 and concave side 28. The concave side 28 is the side generally facing vehicular traffic.

Post 26 is provided with an upper reinforcing cap 34 and a lower reinforcing cap 36 which are preferably formed of a polyurethane material. Caps 34 and 36 have been found to reduce the stress on post 26 and enhance the lifespan thereof. As may be seen in the drawings, caps 34 and 36 completely encapsulate the upper and lower ends respectively.

For assembling the route marker, bolts 40 are used to secure the two uprights 18 together. A filler 38 may be utilized to provide proper spacing with filler 38 being of a thickness appropriate to maintain post 26 under a desired degree of compression. Bolts 42 in turn are used to secure post 26 between flexible markers 22 and 24. As seen in the drawings there is a gap 41 formed between flexible members 22 and 24 to provide a bending zone.

It will be understood that the above described embodiment is for purposes of illustration only and that changes and modifications may be made thereto without departing from the spirit and scope of the invention.

I claim:

1. A flexible marker post assembly comprising:

a base;

first and second flexible members of an elastomeric material secured to said base and extending upwardly therefrom;

a substantially rigid post mounted intermediate of an upper portion of said first and second flexible members, said post having a lower end thereof secured to an upper portion of said first and second flexible members, said post being substantially coplanar with said first and second flexible members, said post having a reflective material thereon;

said first and second flexible members having a bending zone located between where said flexible members are secured to said base and where said lower end of said post extends; and an upper reinforcing portion encapsulating an upper end of said post, and a lower reinforcing portion encapsulating said lower end of said post, said lower reinforcing portion extending from a lower end of said post to a point above said first and second flexible members.

2. The flexible marker post assembly of claim 1 wherein said post has a concave/convex configuration.

3. The flexible marker post assembly of claim 1 wherein said post is formed of a fiberglass material.

4. The flexible marker post assembly of claim 1 wherein said reinforcing portions are formed of a polyurethane material.

5. The flexible marker post assembly of claim 1 wherein said first and second flexible members are formed from an elastomeric material.

6. The flexible marker post assembly of claim 5 wherein said elastomeric material is rubber.

7. The flexible marker post assembly of claim 1 further including a flexible filler piece located intermediate a lower portion of said first and second flexible members.

8. The flexible marker post assembly of claim 1 wherein said base comprises first and second brackets, each of said brackets having a horizontal portion for securement to a substrate and a vertical portion for securement to said flexible members, said lower end of said post and said lower reinforcing portion being located between said flexible members.

9. The flexible marker post assembly of claim 8 wherein said lower reinforcing portion extends from said lower end of said post upwardly to a point above where said post is retained by said first and second flexible members.

* * * * *